United States Patent [19]

Bick

[11] Patent Number: 4,501,955

[45] Date of Patent: Feb. 26, 1985

[54] ROTATABLE HEATING APPARATUS

[76] Inventor: Hal W. Bick, P.O. Box 20386, Billings, Mont. 59104

[21] Appl. No.: 553,521

[22] Filed: Nov. 21, 1983

[51] Int. Cl.[3] ..... F28D 11/02

[52] U.S. Cl. ..... 219/469; 34/124; 165/90; 219/244; 219/470; 219/530

[58] Field of Search ..... 219/216, 244, 389, 469, 219/470, 471, 494, 516, 530; 34/108, 110, 113, 124; 38/49; 165/89, 90; 29/129.5, 125; 138/148

[56] References Cited

U.S. PATENT DOCUMENTS

| | | | |
|---|---|---|---|
| 1,978,081 | 10/1934 | Hanson | 219/470 |
| 2,700,094 | 1/1955 | Hosack | 219/469 X |
| 2,739,218 | 3/1956 | Wennerlund | 219/469 |
| 2,831,097 | 4/1958 | Malewski | 219/470 |
| 3,105,133 | 9/1963 | Norton | 219/469 |
| 3,423,573 | 1/1969 | Richards et al. | 219/469 |
| 3,471,683 | 10/1969 | Bogue | 219/469 |
| 3,667,542 | 6/1972 | Parkes | 165/89 |
| 4,105,896 | 8/1978 | Schuster | 219/470 |
| 4,158,128 | 6/1979 | Evdokimov et al. | 219/469 |
| 4,229,644 | 10/1980 | Namiki et al. | 219/469 |

FOREIGN PATENT DOCUMENTS

| | | | |
|---|---|---|---|
| 324801 | 9/1920 | Fed. Rep. of Germany | 219/469 |
| 1226287 | 10/1966 | Fed. Rep. of Germany | 219/470 |
| 1552068 | 1/1969 | France | 219/469 |
| 427654 | 7/1967 | Switzerland | 219/469 |

*Primary Examiner*—Volodymyr Y. Mayewsky
*Attorney, Agent, or Firm*—Arthur L. Urban

[57] ABSTRACT

Rotatable heating apparatus including a support portion, a shell portion, a heating portion, a power supply portion and a control portion; the support portion including a frame section, the frame section including spaced upstanding sections, the upstanding sections including shaft supports; the shell portion including a substantially cylindrical outer section, a smaller substantially cylindrical inner section disposed within the outer section adjacent thereto and spaced therefrom, substantially parallel first and second end sections adjacent the ends of the cylindrical inner section, first and second annular sections enclosing the spacing between the ends of the inner and outer cylindrical sections, a shaft member disposed along the axis of the shell portion; the heating portion including a plurality of spaced electrical heating elements disposed between the inner and outer cylindrical sections, the heating elements extending from the first annular section to a point adjacent the second annular section, insulating support members disposed along the lengths of the heating elements, the power supply portion including an electrical collector; electrical connectors extending from each of the heating elements adjacent the first annular section to the collector, a rotatable drive operatively connected to the shaft member; the control portion including a thermostat for the heating elements and a speed control for the drive.

19 Claims, 5 Drawing Figures

ROTATABLE HEATING APPARATUS

This invention relates to a novel heating apparatus and more particularly relates to a new rotatable heating apparatus.

Heating devices have been used throughout history. Originally, heating was produced by exposure to the sun or to an open fire. Objects or bodies were heated to dry them and/or warm them.

With the development of civilization, special heating devices were developed to accomplish specific objectives. For example, stoves were designed for cooking within a building. Also, furnaces and fireplaces were employed for heating certain areas of a building.

Industrial and commercial applications involved the heating of products during processing. One common heating apparatus is the oven or chamber. While ovens provide satisfactory results under some processing conditions, they are less than satisfactory under other situations. For example, for high speed processing, ovens may not heat fast enough. Also, if a product needs to be heated continuously, ovens may not operate efficiently because of inadequate means for confining the heat within the chamber.

In an attempt to overcome the deficiencies of ovens, other heating devices have been proposed and adopted. One such expedient is the use of heated rolls or cylinders. Such cylinders are especially useful in the heating of continuous materials. The cylinders can be driven at a desired rate with the product passing continuously around the surface of the rotating cylinder.

One application in which cylinders commonly are employed is in the heat treatment of textile materials such as fabrics. Rolls of fabric are dried, heat set, etc. on a continuous basis by passing the fabric around the periphery of one or a series of cylinders.

Cylinders employed in the textile industry generally are heated by pumping steam or hot water into the interior of the cylinder. The steam or hot water can be supplied from the normal heating sources, e.g. a boiler of the building in which the processing is being done. By varying the temperature of the heating fluid and the speed of rotation of the cylinder, reasonable control of the heating process can be achieved.

Although steam heated cylinders can be used successfully in some textile processing, they are not without their own problems. If a relatively high temperature is needed, the steam must be at a high pressure. This requires a high pressure piping system. Also, the boiler must be located relatively close to the cylinders and/or the piping must be heavily insulated to minimize heat losses.

If concentrated heat treatment is required, greater heat capability must be provided. With steam heating, this can be achieved by slowing the rotational speed of the cylinders or increasing the number of cylinders.

The use of steam boilers also may present certain limitations. The boiler may have to be fired exclusively for the operation of the cylinders when the steam is not required for other purposes such as during the summer or in warm climates. Secondly, a larger size boiler would be required to furnish steam to the cylinders as well as for the normal uses. This would significantly increase the boiler investment.

Another complicating factor is that the boiler must be fired for a long time before processing can begin. This restricts the operating flexibility and makes last minute changes inappropriate. The problems of boiler lead time are accentuated when only a short run is contemplated since the startup time is the same whether the processing period is short or long in duration.

From the above discussion, it is clear that present and past methods and apparatus for heating textiles leave much to be desired. Thus, there is a need for new textile heating apparatus that do not place limitations or restrictions on operating procedures.

The present invention provides a novel rotatable heating apparatus that overcomes the shortcomings and deficiencies of previous heating devices. The heating apparatus of the invention provides high temperatures at low vapor pressures without high pressure piping. Products can be processed more rapidly with less equipment. Thus, operating costs are low. Furthermore, these results can be achieved without steam boilers and the problems inherent in the use thereof.

High temperatures can be achieved quickly and conveniently in a few minutes of time. Thus, short runs are practical and last minute processing changes can be made without waste and inefficiency.

Temperatures can be regulated within narrow limits with each apparatus being operated at a different temperature if desired. Thus, the temperatures of succeeding apparatus can be increased or decreased to provide optimum heat treatment of the product. Separate automatic temperature control of each apparatus can be achieved easily.

The heating apparatus of the present invention is simple in design and can be produced relatively inexpensively. Commercially available materials and components can be utilized in its fabrication. Conventional metal working techniques and procedures and semi-skilled labor can be used in its manufacture.

The heating apparatus can be utilized in existing or new installations. The apparatus can be installed in a short period of time. Operators can learn to use the apparatus efficiently with a minimum of instruction. The apparatus provides a high degree of operating versatility so it can be adapted for a variety of different heat treatments. The apparatus is durable in construction and has a long useful life. Little maintenance is required to keep the apparatus in good working condition.

These and other benefits and advantages of the novel rotatable heating apparatus of the present invention will be apparent from the following description and the accompanying drawings in which.

Figure 1:
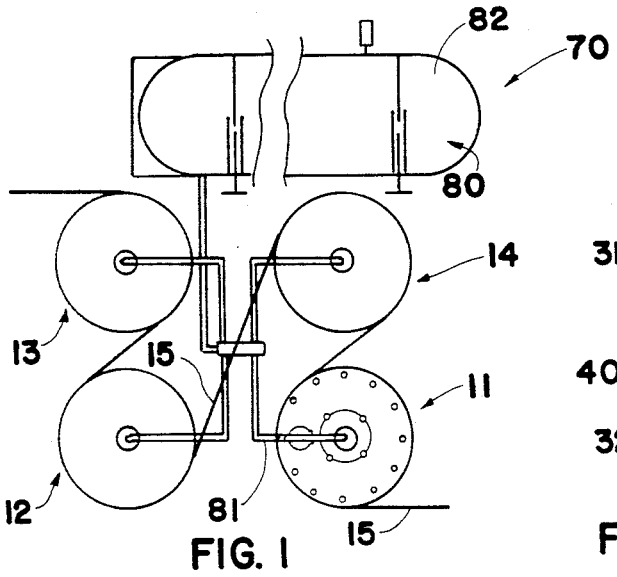
FIG. 1 is a side view of the rotatable heating apparatus of the invention in use.
Figure 3:
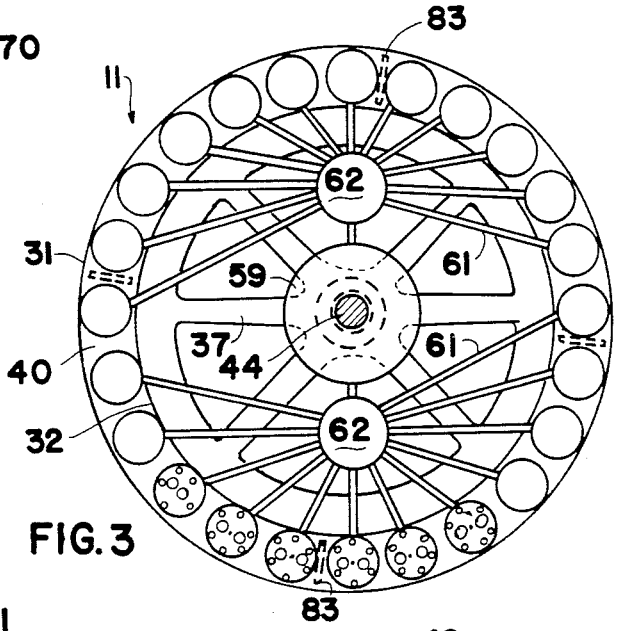
FIG. 3 is a sectional view of the rotatable heating apparatus shown in FIG. 2 taken along line 3—3 thereof.
Figure 2:
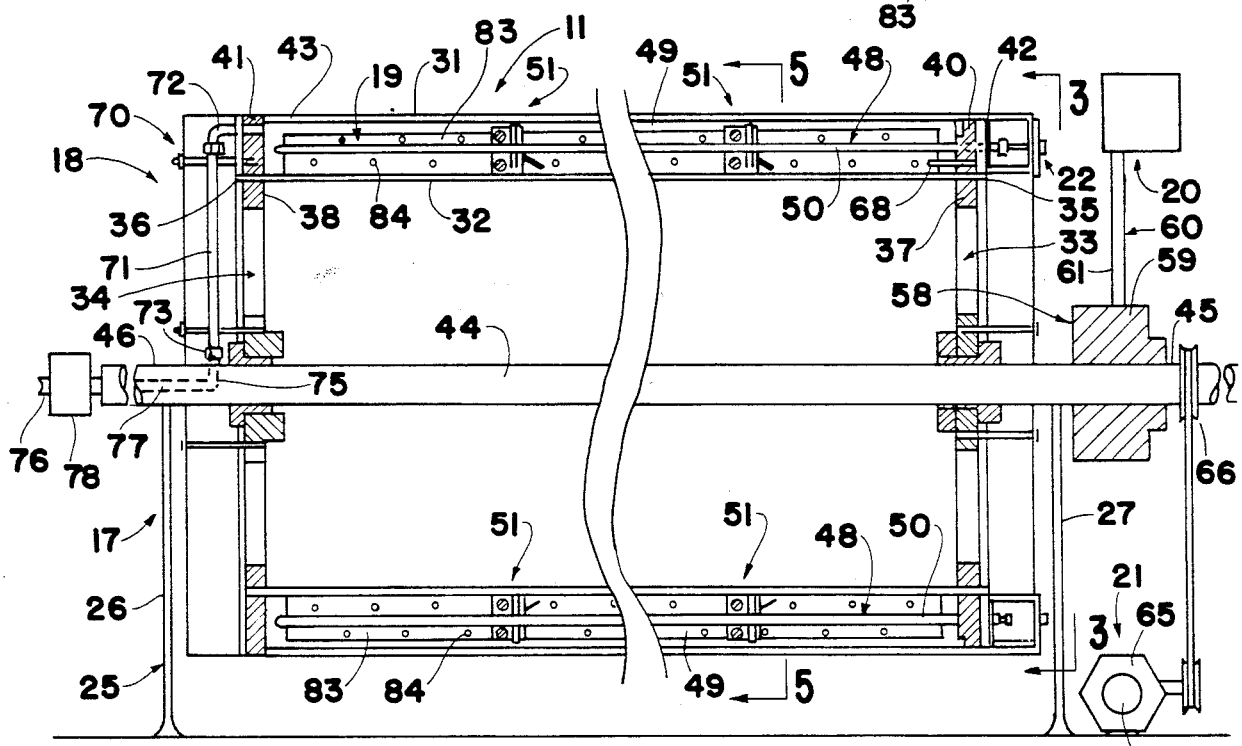
FIG. 2 is an enlarged side view in section of the rotatable heating apparatus shown in FIG. 1.
Figure 4:
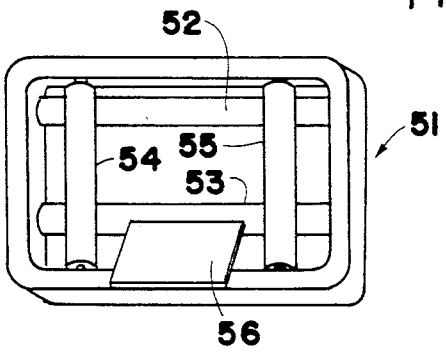
FIG. 4 is a view in perspective of an insulating support member of the apparatus shown in FIG. 2.
Figure 5:
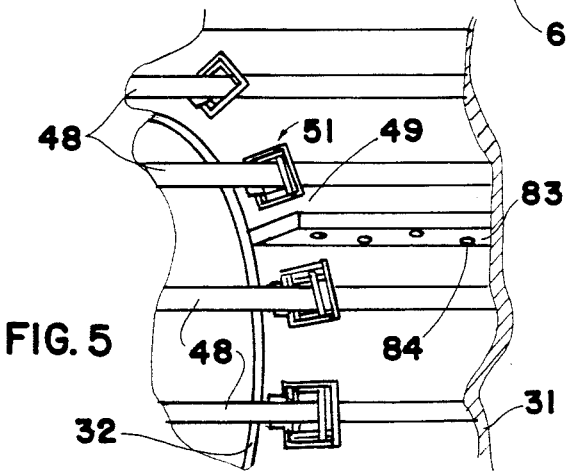
FIG. 5 is a fragmentary sectional view of the rotatable heating apparatus shown in FIG. 2 taken along line 5—5 thereof.

As shown in the drawings, one form of the novel rotatable heating apparatus 11 of the present invention is combined with similar apparatus 12, 13 and 14 in a closely spaced substantially parallel relationship for the heat treatment of a fabric 15. The rotatable heating apparatus 11 of the invention includes a support portion 17, a shell portion 18, a heating portion 19, a power supply portion 20, a drive portion 21 and a control portion 22.

The support portion 17 of the heating apparatus 11 includes a frame section 25. The frame section 25 includes spaced upstanding sections 26 and 27. The upstanding sections include shaft support means 28 and 29 respectively. Advantageously, the shaft supports 26 and 27 are disposed in a generally horizontal plane. The support portion 17 preferably includes pairs of shaft support means for each of the apparatus 12, 13 and 14.

The shell portion 18 of the heating apparatus 11 includes a substantially cylindrical outer section 31. A smaller substantially cylindrical inner section 32 is disposed within the outer section 31. The inner section 32 is disposed adjacent to the outer section 31 and spaced therefrom.

The inner and outer cylindrical sections 31 and 32 advantageously are arranged concentrically. Preferably, the distance or spacing between the inner and outer cylindrical sections 31 and 32 is substantially less than the radius of the inner section 32. The length of the shell portion advantageously is greater than the diameter thereof.

The shell portion 18 also includes substantially parallel first and second end sections 33 and 34 disposed adjacent the ends 35 and 36 of the inner cylindrical section 31. Advantageously, as shown, the end sections 33 and 34 are spoked end members 37 and 38.

First and second annular sections 40 and 41 enclose the space between the ends 35 and 36 of inner section 32 and the adjacent ends 42 and 43 of the outer cylindrical section 31. Insulation preferably covers the ends of the shell portion 18.

A shaft member 44 is disposed along the axis of the shell portion. The ends 45 and 46 of the shaft member 44 extend beyond the end sections 33 and 34 to the shaft supports 26 and 27.

The heating portion 19 of the apparatus 11 of the invention includes a plurality of spaced electrical heating elements 48. The heating elements 48 are disposed between the inner and outer cylindrical sections 31 and 32. The heating elements extend from the first annular section 40 to a point adjacent the second annular section 41.

Advantageously, the heating elements 48 are substantially equally spaced around the annular space 49 between the inner and outer cylindrical sections 31 and 32. The heating elements preferably are rigid rod members 50.

Insulating support members 51 are disposed along the lengths of the heating elements 48. The support members space the heating elements from the cylindrical sections 31 and 32. The support members advantageously include pairs of spaced elongated insulator fingers 52/53 and 54/55 that are disposed at substantially right angles to the other pair. To facilitate positioning of the heating elements, the support members preferably include an inclined guide section 56.

The power supply portion 20 includes electrical collector means 58 disposed on the shaft member 44 adjacent to the first end section 33. The collector 58 advantageously includes a ring member 59.

Electrical connector means 60 extend from each of the heating elements 48 adjacent the first annular section 40 to the collector means 58. The connectors 60 preferably include flexible conduit sections 61. The conduits 61 extend from the heating elements to intermediate collecting means 62 that in turn are interconnected to the collecting ring 59.

The drive portion 21 includes rotatable drive means 64 shown as electrical motor 65. The drive means is operatively connected to shaft member 44. This connection may be through suitable means such as a belt and pulley combination 66.

The control portion 22 of the heating apparatus 11 of the invention includes speed control means 67 for the drive means 64 and thermostat means 68 for the heating elements 48. Advantageously, the thermostat 68 is located adjacent the heating elements. Preferably, the thermostat is located in the annular space between the cylindrical sections 31 and 32.

Advantageously, the heating apparatus 11 of the invention also includes means 70 for providing a fluid transfer medium to the annular space 49 between the inner and outer cylindrical sections 31 and 32. The means 70 preferably includes a first conduit means 71, one end 72 of which is connected to the space 49 between the inner and outer cylindrical sections 31 and 32. The opposite end 73 of the first conduit communicates with one end 75 of second conduit means 76 disposed adjacent to the axis of the shaft member 44.

The first conduit means 71 advantageously is disposed adjacent the second end section 34. The second conduit means 76 preferably includes a section 77 that is disposed along the axis of the shaft member 44. It is advantageous for this section 77 to include a hollow section of the shaft member. Preferably, the second conduit means 76 includes a rotatable union fitting 78.

Fluid expansion means 80 is connected to the second conduit means 76 at a point 81 remote from the second end section 34. The fluid expansion means 80 advantageously includes a storage tank 82. Baffles 83 with openings 84 preferably located within annular space 49 mix the fluid transfer medium therein as the shell portion 18 rotates.

The rotatable heating apparatus 11 of the invention may be fabricated from a variety of structural materials such as carbon steel, stainless steel, etc. The peripheral surface of the outer cylindrical section 31 may be coated to provide a special surface such as a low friction Teflon coating.

The rotatable heating apparatus 11 of the present invention can be used singly or in combination with similar heating apparatus 12—14 as shown in FIG. 1. Each apparatus is heated to a temperature which may be the same or different from that of the others as desired. A continuous fabric 15 is threaded between the units in a manner as shown. The apparatus now is ready for use.

The fabric is advanced through the apparatus by the rotation of the apparatus with motor 65. While the fabric is moving through the apparatus, the desired heat treatment of the fabric is effected. For example, the fabric can be dried or in the case of thermoplastic materials, the fabric can be heat set.

In the same way, other substrates such as fiber tows, plastic films and non-woven fabrics and the like also can be heat treated with the apparatus of the invention. In addition, coatings on substrates can be dried or cured.

The above description and the accompanying drawings show that the present invention provides a novel rotatable heating apparatus that provides benefits and advantages not available previously. High temperatures can be attained in a few minutes. Individual apparatus in an assembly can be operated at different temperatures simply and conveniently. Automatic temperature control can be achieved easily. A large volume of products can be processed rapidly with a minimum investment in equipment. Steam boilers and high pressure piping and the problems inherent in their use are eliminated.

The heating apparatus can be fabricated relatively inexpensively from commercially available materials and components employing conventional manufacturing techniques. The apparatus is durable in construction and requires little maintenance.

The heating apparatus can be operated economically and efficiently using operators of conventional heat treating equipment after only a minimum of instruction. The apparatus can be used successfully to perform a wide variety of heating treatments under different operating conditions.

It will be apparent that various modifications can be made in the particular rotatable heating apparatus described in detail above and shown in the drawings within the scope of the invention. The size, configuration and arrangement of components can be changed to meet specific requirements. These and other changes can be made in the heating apparatus provided the functioning and operation thereof are not adversely affected. Therefore, the scope of the present invention is to be limited only by the following claims.

What is claimed is:

1. Rotatable heating apparatus including a support portion, a shell portion, a heating portion, a drive portion, a power supply portion and a control portion; said support portion including a frame section, said frame section including spaced upstanding sections, said upstanding sections including shaft support means; said shell portion including a substantially cylindrical outer section, a smaller substantially cylindrical inner section disposed within said outer section adjacent thereto and spaced therefrom, substantially parallel first and second end sections adjacent the ends of said cylindrical inner section, first and second annular sections enclosing the spacing between the ends of said inner and outer cylindrical sections, a shaft member disposed along the axis of said shell portion, ends of said shaft member extending outwardly beyond said end sections to said shaft support means; said heating portion including a plurality of spaced electrical heating elements disposed between said inner and outer cylindrical sections, said heating elements extending from said first annular section to a point adjacent said second annular section, insulating support members disposed along the lengths of said heating elements spacing them from said cylindrical sections, said power supply portion including electrical collector means disposed on said shaft member adjacent to said first end section, electrical connector means extending from each of said heating elements adjacent said first annular section to said collector means; said drive portion including rotatable drive means disposed adjacent to said support portion, said drive means being operatively connected to said shaft member; said control portion including thermostat means for said heating elements and speed control means for said drive means; whereby a continuous substrate can be heated as it contacts said cylindrical outer section of said rotatable shell portion.

2. Rotatable heating apparatus according to claim 1 wherein said shaft support means of said support portion are disposed in a generally horizontal plane.

3. Rotatable heating apparatus according to claim 1 wherein said inner and outer cylindrical sections are arranged concentrically.

4. Rotatable heating apparatus according to claim 1 wherein the spacing between said inner and outer cylindrical sections is substantially less than the radius of said inner section.

5. Rotatable heating apparatus according to claim 1 wherein the length of said shell portion is greater than the diameter thereof.

6. Rotatable heating apparatus according to claim 1 wherein said end sections include spoked end members.

7. Rotatable heating apparatus according to claim 1 including insulation enclosing said end sections and said annular sections.

8. Rotatable heating apparatus according to claim 1 wherein said heating elements are substantially equally spaced around the annular space between said inner and outer cylindrical sections.

9. Rotatable heating apparatus according to claim 1 wherein said heating elements include rigid rod members.

10. Rotatable heating apparatus according to claim 1 wherein said electrical connector means includes flexible conduit sections extending from said heating elements to common collecting means.

11. Rotatable heating apparatus according to claim 1 wherein said electrical collector means includes a ring member.

12. Rotatable heating apparatus according to claim 1 wherein said drive means includes an electrical motor.

13. Rotatable heating apparatus according to claim 1 including first conduit means connecting the space between said inner and outer cylindrical sections with second conduit means disposed adjacent to said axis of said shaft member and fluid expansion means connected to said second conduit means remote from said second end section.

14. Rotatable heating apparatus according to claim 13 wherein said first conduit means is disposed adjacent said second end section.

15. Rotatable heating apparatus according to claim 13 wherein said second conduit means includes a section disposed along the axis of said shaft member.

16. Rotatable heating apparatus according to claim 15 wherein said second conduit means includes a hollow shaft member section.

17. Rotatable heating apparatus according to claim 13 wherein said second conduit means includes a rotatable union fitting.

18. Rotatable heating apparatus according to claim 13 wherein said fluid expansion means includes a storage tank.

19. Rotatable heating apparatus according to claim 1 wherein said apparatus includes a plurality of closely spaced substantially parallel shell portions.

* * * * *